US011501725B2

(12) United States Patent
Cheng et al.

(10) Patent No.: US 11,501,725 B2
(45) Date of Patent: Nov. 15, 2022

(54) E-PAPER DISPLAY DEVICE AND A METHOD FOR DRIVING AN E-PAPER DISPLAY PANEL THAT PRE-DRIVES A DISPLAY AREA ACCORDING TO A CURRENT DISPLAY LINE SEGMENT

(71) Applicant: E Ink Holdings Inc., Hsinchu (TW)

(72) Inventors: Hsiao-Lung Cheng, Hsinchu (TW); Shu-Cheng Liu, Hsinchu (TW); Pei-Lin Tien, Hsinchu (TW); Chi-Mao Hung, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/369,978

(22) Filed: Jul. 8, 2021

(65) Prior Publication Data

US 2022/0013073 A1 Jan. 13, 2022

(30) Foreign Application Priority Data

Jul. 13, 2020 (TW) ..... 109123498

(51) Int. Cl.
*G09G 3/34* (2006.01)
*G09G 3/20* (2006.01)

(52) U.S. Cl.
CPC ..... *G09G 3/344* (2013.01); *G09G 3/2003* (2013.01)

(58) Field of Classification Search
None
See application file for complete search history.

(56) References Cited

U.S. PATENT DOCUMENTS

| | | | | |
|---|---|---|---|---|
| 9,697,625 | B2 | 7/2017 | Bonacina et al. | |
| 9,753,579 | B2 | 9/2017 | Johansson et al. | |
| 9,824,684 | B2 | 11/2017 | Yu et al. | |
| 2006/0250349 | A1* | 11/2006 | Kim | G09G 3/344 345/107 |
| 2008/0111786 | A1 | 5/2008 | Goudarzi | |
| 2008/0309612 | A1* | 12/2008 | Gormish | G09G 3/3433 345/105 |

(Continued)

FOREIGN PATENT DOCUMENTS

| | | |
|---|---|---|
| CN | 101840666 | 9/2010 |
| CN | 101533198 | 5/2013 |
| TW | 201131271 | 9/2011 |

OTHER PUBLICATIONS

"Office Action of Taiwan Counterpart Application", dated Nov. 26, 2021, p. 1-p. 3.

*Primary Examiner* — Kirk W Hermann
(74) *Attorney, Agent, or Firm* — JCIPRNET

(57) ABSTRACT

An e-paper display device, including a driver circuit. The driver circuit is coupled to the e-paper display panel and drives the e-paper display panel to display one or more line segments, which include a current display line segment and a target display line segment. During a frame period, the driver circuit pre-drives a display area to display a first color according to the current display line segment. At least part of the target display line segment is located in the display area. During a next frame period, the driver circuit drives a part of the display area excluding the target display line segment to display a second color and a part of the display area including the target display line segment to display the first color according to the target display line segment. A method for driving an e-paper display panel.

16 Claims, 6 Drawing Sheets

(56) References Cited

U.S. PATENT DOCUMENTS

| | | | | |
|---|---|---|---|---|
| 2008/0309636 | A1* | 12/2008 | Feng | G09G 3/344 345/173 |
| 2011/0175821 | A1* | 7/2011 | King | G06F 3/04883 345/173 |
| 2013/0016126 | A1* | 1/2013 | Wang | G06F 3/0488 345/650 |
| 2013/0201112 | A1* | 8/2013 | Large | G06F 3/04883 345/173 |
| 2014/0085209 | A1* | 3/2014 | Runde | G06F 3/0488 345/173 |
| 2014/0118295 | A1* | 5/2014 | Motoi | G06F 3/04883 345/174 |
| 2014/0333987 | A1* | 11/2014 | Keam | G06F 3/04883 359/296 |
| 2015/0355778 | A1* | 12/2015 | Kim | G06F 3/0416 345/173 |

* cited by examiner

E-PAPER DISPLAY DEVICE AND A METHOD FOR DRIVING AN E-PAPER DISPLAY PANEL THAT PRE-DRIVES A DISPLAY AREA ACCORDING TO A CURRENT DISPLAY LINE SEGMENT

CROSS-REFERENCE TO RELATED APPLICATION

This application claims the priority benefit of Taiwan application serial no. 109123498, filed on Jul. 13, 2020. The entirety of the above-mentioned patent application is hereby incorporated by reference herein and made a part of this specification.

BACKGROUND

Technical Field

This disclosure relates to a display device and a method for driving a display panel, and in particular to an e-paper display device and a method for driving an e-paper display panel.

Description of Related Art

An electronic paper display (e-paper display) uses a large number of microcapsules (that is, electronic ink) which like optical components, may display electronic content on a plastic film layer. The clear solution in each microcapsule contains multiple positively charged white particles and multiple negatively charged black particles. When a positive electric field or a negative electric field is applied, the corresponding particles will move to the top end of the microcapsule, so that a user may see the particles, and this causes the display film layer to appear white or black. With the development of electronic display technology, characteristics of e-paper display, such as high brightness, low power consumption, and being flexible, have enabled e-paper display to be used in various display applications.

However, when driving the e-paper display to display a line segment according to the current method for displaying a line segment, the e-paper display has to first receive an exact point before connecting it to the previous point to complete the display of the line segment. However, this method may cause the e-paper display to respond too slowly and fail to provide a good user experience.

SUMMARY

This disclosure provides an electronic paper display (e-paper display) device and a method for driving an e-paper display panel, which can save driving time, allowing the response of the e-paper display device to be faster, and providing a good user experience.

An e-paper display device of the disclosure includes an e-paper display panel and a driver circuit. The e-paper display panel is configured to display one or more line segments. The one or more line segments include a current display line segment and a target display line segment. The driver circuit is coupled to the e-paper display panel. The driver circuit is configured to drive the e-paper display panel to display the one or more line segments. During a frame period, the driver circuit pre-drives a display area to display a first color according to the current display line segment. At least part of the target display line segment is located in the display area. During a next frame period, the driver circuit drives a part of the display area excluding the target display line segment to display a second color, and drives a part of the display area including the target display line segment to display the first color according to the target display line segment.

A method for driving an e-paper display panel of the disclosure is configured to drive the e-paper display panel to display a current display line segment and a target display line segment. The driving method includes the following steps. During a frame period, a display area is pre-driven to display a first color according to the current display line segment. At least part of the target display line segment is located in the display area. During a next frame period, a part of the display area excluding the target display line segment is driven to display a second color, and a part of the display area including the target display line segment is driven to display the first color according to the target display line segment.

Based on the above, in the embodiments of the disclosure, the e-paper display device and the method for driving the e-paper display panel pre-drive the display area according to the current display line segment, allowing the response of the e-paper display device to be faster, and providing a good user experience.

To make the above features and advantages more comprehensible, several embodiments accompanied by drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
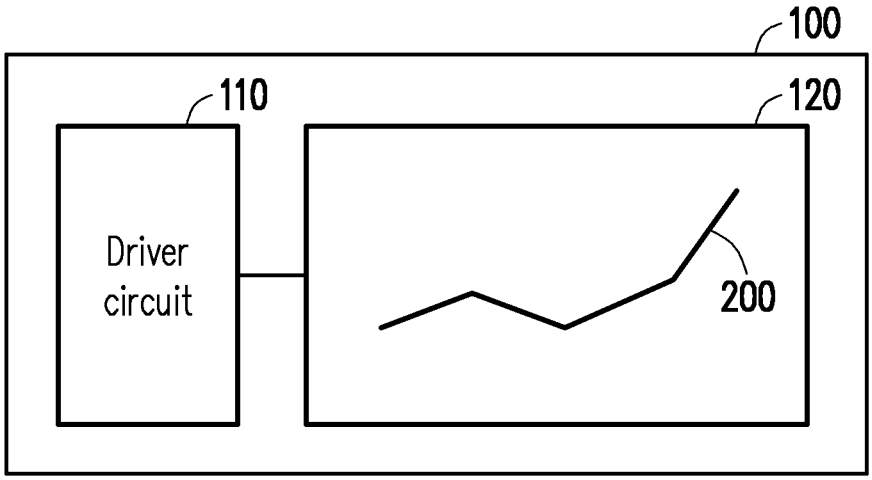
FIG. 1 is a schematic diagram of an electronic paper display (e-paper display) device according to an embodiment of the disclosure.

FIG. 1 is a schematic diagram of an electronic paper display (e-paper display) device according to an embodiment of the disclosure. With reference to FIG. 1, an e-paper display device 100 of the embodiment includes a driver circuit 110 and an e-paper display panel 120. The e-paper display panel 120 is configured to display one or more line segments 200. The driver circuit 110 is coupled to the e-paper display panel 120. The driver circuit 110 is configured to drive the e-paper display panel 120 to display the line segment 200.

In the embodiment, the e-paper display device 100 is, for example, a black and white e-paper display device. Therefore, the line segment 200 is a black or darker grayscale line, and the background of the line segment 200 is a white or brighter grayscale image. However, the disclosure is not limited thereto. In an embodiment, the e-paper display device 100 may also be a colored e-paper display device. Therefore, the line and its background color may be changed according to actual display requirements.

Figure 2:
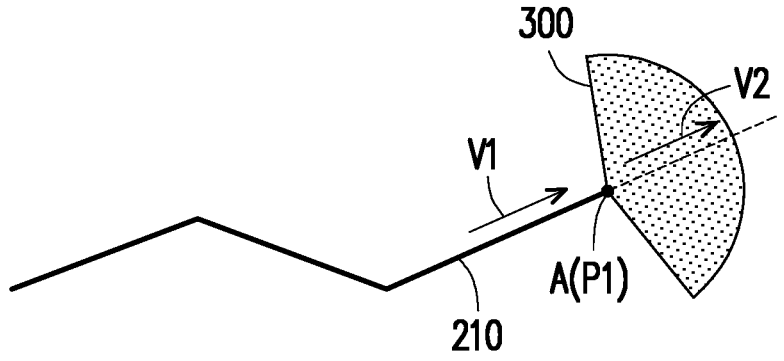
FIGS. 2 and 3 are respectively schematic diagrams of the e-paper display device of the embodiment in FIG. 1 displaying line segments during different frame periods.
Figure 3:
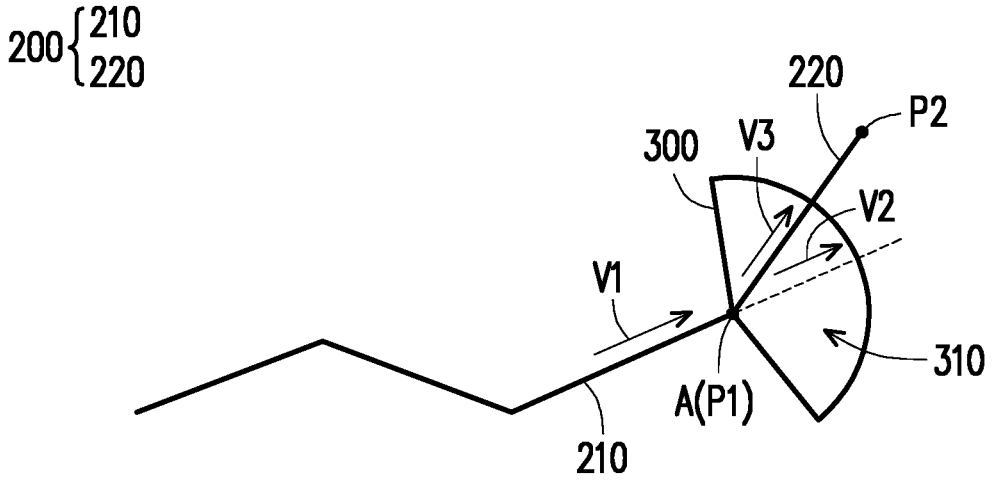

FIGS. 2 and 3 are respectively schematic diagrams of the e-paper display device of the embodiment in FIG. 1 displaying line segments during different frame periods. With reference to FIGS. 1 to 3, FIG. 2 shows the e-paper display device displaying the line segment 200, which includes a current display line segment 210, during a first frame period. FIG. 3 shows the e-paper display device displaying the line segment 200, which includes a target display line segment 220, during a second frame period. In the embodiment, the second frame period is a next frame period of the first frame period.

In the embodiment, during the first frame period, the driver circuit 110 pre-drives a display area 300 to display black (first color) or a darker grayscale (first grayscale), according to the current display line segment 210. Next, during the second frame period, the driver circuit 110 drives a part of the display area 300 excluding the target display line segment 220 to display white (second color) or a brighter grayscale (second grayscale), according to the target display line segment 220, to serve as the background color. Simultaneously, the driver circuit 110 drives the part of the display area 300 including the target display line segment 220 to display black to serve as the line segment color.

In the embodiment, a part of the target display line segment 220 is located in the pre-driven display area 300, but the disclosure is not limited thereto. In an embodiment, if the pre-driven display area 300 is set to be larger, all line segments of the target display line segment 220 may be located in the pre-driven display area 300.

In the embodiment, the pre-driven display area 300 is, for example, a fan-shaped area. An apex A of the fan-shaped area is a terminal point P1 of the current display line segment 210. The driver circuit 110 determines a center vector V2 of the fan-shaped area according to a direction vector V1 of the current display line segment 210. In other words, the driver circuit 110 pre-drives the fan-shaped display area 300 to display black according to the direction vector V1 of the current display line segment 210. After the driver circuit 110 receives a display data of the target display line segment 220 and confirms a terminal point P2 of the target display line segment 220, the driver circuit 110 determines a direction vector V3 of the target display line segment 220 according to the terminal point P1 of the current display line segment 210 and the terminal point P2 of the target display line segment 220, as shown in FIG. 3. In the embodiment, the terminal point of the current display line segment 210 and the starting point of the target display line segment 220 are the same, and both are the point P1.

In the embodiment, the direction vector V3 of the target display line segment 220 is different from the direction vector V1 of the current display line segment 210, but the disclosure is not limited thereto. In an embodiment, the direction vector V3 of the target display line segment 220 may be the same as the direction vector V1 of the current display line segment 210. In other words, the directions indicated by the direction vectors V1, V3, and the center vector V2 of the fan-shaped area are the same.

Figure 4:
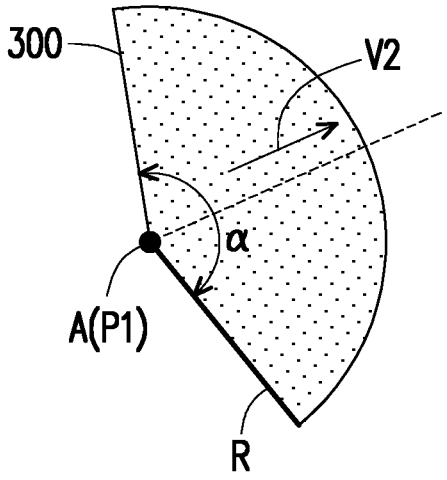
FIG. 4 is a schematic diagram of geometric parameters of a fan-shaped area according to an embodiment of the disclosure.

FIG. 4 is a schematic diagram of geometric parameters of the fan-shaped area according to an embodiment of the disclosure. With reference to FIG. 4, the geometric parameters of the embodiment include the center vector V2, a central angle $\alpha$, a radius R, and the apex A. The central angle $\alpha$ and the radius R may be pre-determined according to actual design requirements and may be set by the user, for example. The apex A of the fan-shaped area 300 is the terminal point P1 of the current display line segment 210. The center vector V2 of the fan-shaped area 300 refers to a direction vector located at an angle $\alpha/2$ in the fan-shaped area 300. The center vector V2 of the fan-shaped area 300 is determined by the direction vector V1 of the current display line segment 210. Therefore, the fan-shaped area 300 is an area where the point A is the apex, the radius R is the radial length, and the center vector V2 is the center direction, opening one-half of the central angle in both the clockwise and counterclockwise directions.

In the embodiment, the driver circuit 110 calculates the size of the fan-shaped area 300 according to the center vector V2, the central angle $\alpha$, and the radius R of the fan-shaped area 300, and accordingly pre-drives the fan-shaped area 300 to display black during the first frame period. Then, during the second frame period, the driver circuit 110 drives a part 310 of the display area 300 excluding the target display line segment 220 to display white according to the target display line segment 220 to serve as the background color, as shown in FIG. 3.

In the embodiments of FIGS. 2 to 4, the display area 300 is, for example, a fan-shaped area, but the disclosure is not limited thereto. In an embodiment, the display area may also be a circular area with the terminal point P1 of the current display line segment 210 as the center, and a radius of the circular area may be predetermined according to actual design requirements and may be set by the user, for example.

In the embodiments of FIGS. 2 to 4, the size and the shape of the pre-driven area are calculated, for example, by the driver circuit 110 according to the geometric parameters of the display area 300, but the disclosure is not limited thereto. In an embodiment, the size and the shape of the display area 300 may also be a reference pattern pre-stored in the e-paper display device 100.

Figure 5:
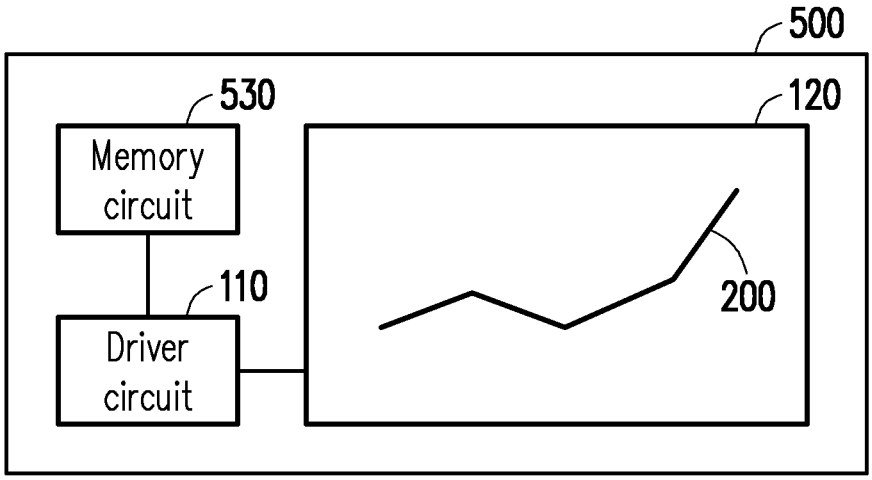
FIG. 5 is a schematic diagram of an e-paper display device according to another embodiment of the disclosure.
Figure 6:
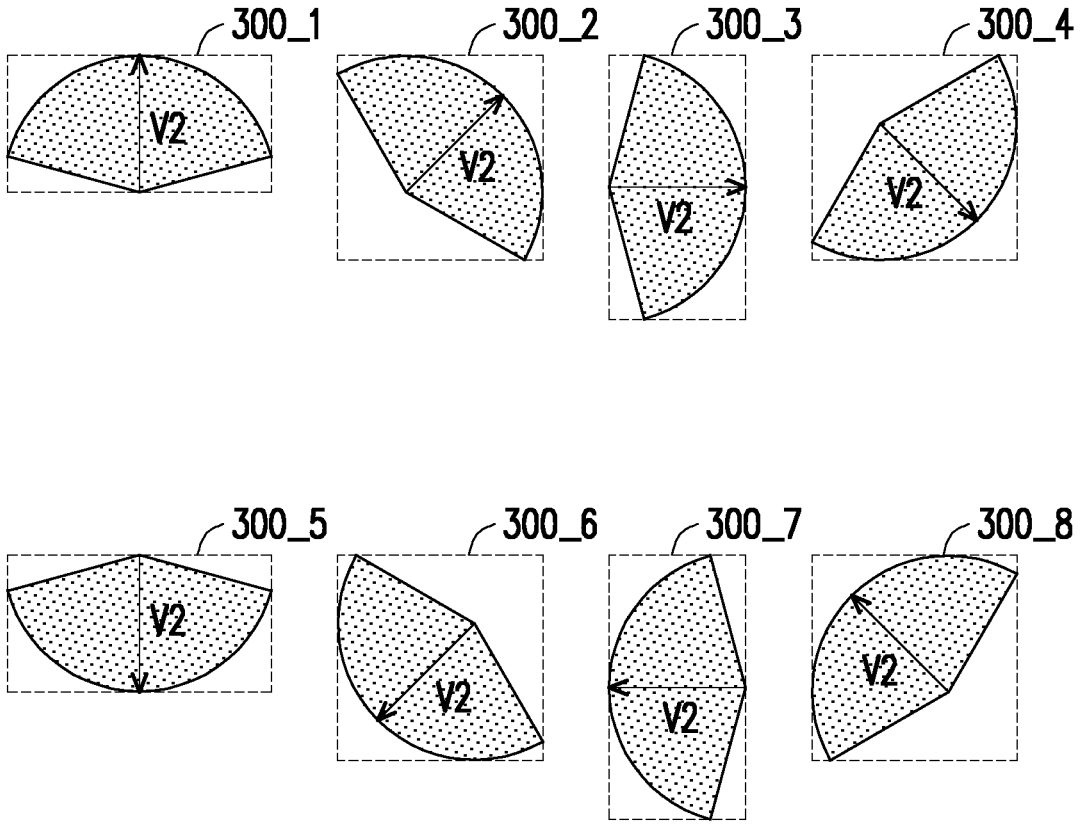
FIG. 6 is a schematic diagram of fan-shaped patterns stored in a memory circuit of the embodiment in FIG. 5.

FIG. 5 is a schematic diagram of an e-paper display device according to another embodiment of the disclosure. FIG. 6 is a schematic diagram of fan-shaped patterns stored in a memory circuit of the embodiment in FIG. 5. With reference to FIGS. 5 and 6, an e-paper display device 500 of the embodiment is similar to the e-paper display device 100 of the embodiment in FIG. 1. The main difference between the two is that, for example, the e-paper display device 500 further includes a memory circuit 530. The memory circuit 530 may be configured inside or outside of the driver circuit 110. The memory circuit 530 is, for example, a register or a memory component.

In the embodiment, the memory circuit 530 is configured to store multiple fan-shaped patterns 300_1, 300_2, 300_3, 300_4, 300_5, 300_6, 300_7, and 300_8 having the center vector V2 in different directions, as shown in FIG. 6. The driver circuit 110 chooses one of the fan-shaped patterns 300_1 to 300_8 in FIG. 6 according to the direction vector V1 of the current display line segment 210 to serve as the pre-driven display area 300. One way to choose is, for example, to choose a fan pattern with the center vector V2 closest to the direction vector V1 as the pre-driven display area 300. The number of fan-shaped patterns and the direction of each of the center vector do not limit the disclosure.

In addition, sufficient teaching, recommendations, and implementation description may be obtained from the description of the embodiments in FIGS. 1 to 4 for the e-paper display device 500 of the embodiment of the disclosure.

Figure 7:
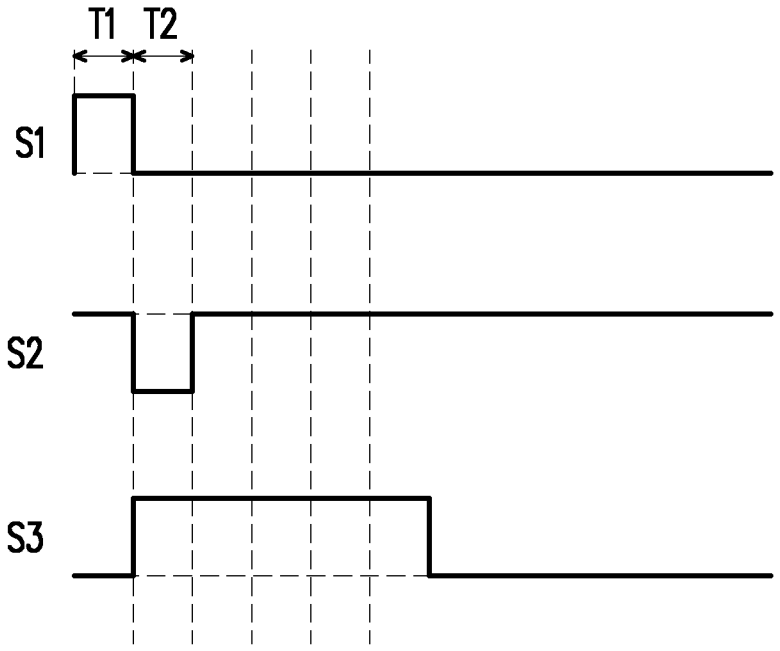
FIG. 7 is a schematic diagram of a driving signal according to an embodiment of the disclosure.

FIG. 7 is a schematic diagram of a driving signal according to an embodiment of the disclosure. With reference to FIG. 1 and FIG. 7, the driver circuit 110 of the embodiment, for example, drives the e-paper display panel 120 to display the line segment 200 according to driving signals S1, S2, and S3. During a first frame period T1, the driver circuit 110 pre-drives the display area 300 to display black according to the driving signal S1. Then, during a second frame period T2, the driver circuit 110 drives a part of the display area 300 excluding the target display line segment 220 to display white according to the driving signal S2. Simultaneously, during the second frame period T2, the driver circuit 110 drives a part of the display area 300 including the target display line segment 220 to display black according to the driving signal S3.

In other words, in the embodiment, since the part of the display area 300 including the target display line segment 220 has been pre-driven to black during the first frame period T1, a level of the driving signal S3 configured to drive the part of the display area 300 including the target display line segment 220 to display black during the second frame period T2 does not need to be pulled up during the first frame period T1. The driving signal S3 saves one frame period in terms of the driving time for driving the display area 300 to display the target display line segment 220.

Figure 8:
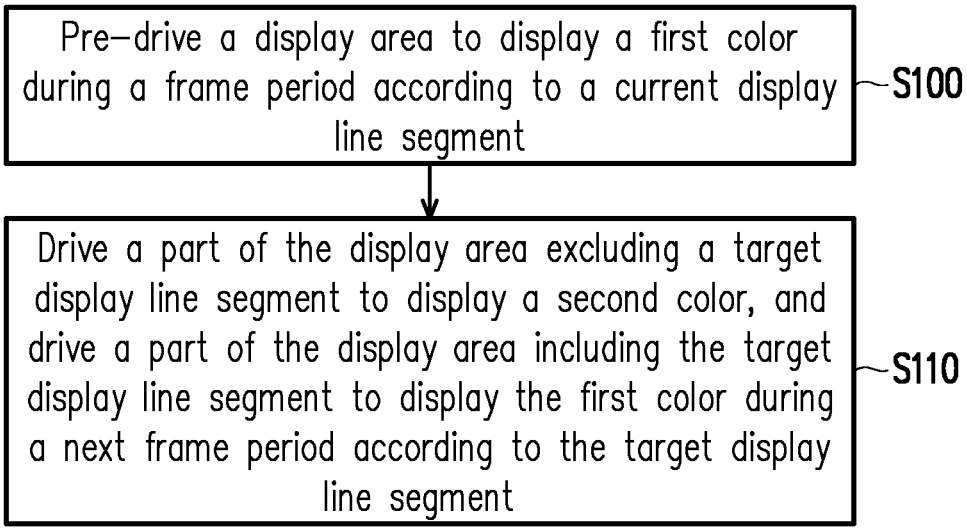
FIG. 8 is a flowchart of the steps of a method for driving an e-paper display panel according to an embodiment of the disclosure.

FIG. 8 is a flowchart of the steps of a method for driving an e-paper display panel according to an embodiment of the disclosure. With reference to FIGS. 1 and 8, the method for driving the e-paper display panel of the embodiment is at least applicable to the e-paper display device 100 in FIG. 1, but the disclosure is not limited thereto. Taking the e-paper display device 100 in FIG. 1 as an example, in Step S100, during the first frame period T1, the driver circuit 110 pre-drives the display area 300 to display the first color according to the current display line segment 210. Next, in Step S110, during the second frame period T2, the driver circuit 110 drives the part of the display area 300 excluding the target display line segment 220 to display the second color and drives the part of the display area 300 including the target display line segment 220 to display the first color according to the target display line segment 220.

In addition, sufficient teaching, recommendations, and implementation description may be obtained from the description of the embodiments in FIGS. 1 to 7 for the method for driving the e-paper display panel of the embodiment of the disclosure.

In summary, in the embodiments of the disclosure, the driver circuit pre-drives a part of the display area of the e-paper display panel according to the current display line segment. During the next frame period, the driver circuit drives the pre-driven area to display the target display line segment, which can save the time of driving the e-paper display panel to display the line segment, allowing the response of the e-paper display device to be faster, and providing a good user experience.

Although the disclosure has been described with reference to the abovementioned embodiments, they are not intended to limit the disclosure. It is apparent that any one of ordinary skill in the art may make changes and modifications to the described embodiments without departing from the spirit and the scope of the disclosure. Accordingly, the scope of the disclosure is defined by the claims appended hereto and their equivalents in which all terms are meant in their broadest reasonable sense unless otherwise indicated.

What is claimed is:

1. An e-paper display device, comprising:

an e-paper display panel, configured to display one or more line segments, wherein the one or more line segments comprise a current display line segment and a target display line segment; and a driver circuit, coupled to the e-paper display panel, configured to drive the e-paper display panel to display the one or more line segments, wherein during a frame period, the driver circuit pre-drives a display area to display a first color according to the current display line segment, wherein at least part of the target display line segment is located in the display area; and during a next frame period, the driver circuit drives a part of the display area excluding the target display line segment to display a second color, and drives a part of the display area including the target display line segment to display the first color according to the target display line segment, wherein the pre-driven display area is a fan-shaped area, and the driver circuit determines a center vector of the fan-shaped area according to a direction vector of the current display line segment, wherein the e-paper display device further comprises:

a memory circuit, configured to store a plurality of fan-shaped patterns, each having the center vector in a different direction, wherein the driver circuit chooses one of the fan-shaped patterns to serve as the pre-driven display area according to the direction vector of the current display line segment.

2. The e-paper display device according to claim 1, wherein a starting point of the target display line segment is a terminal point of the current display line segment, and the driver circuit determines a direction vector of the target display line segment according to the terminal point of the current display line segment and a terminal point of the target display line segment.

3. The e-paper display device according to claim 2, wherein the direction vector of the target display line segment is same as a direction vector of the current display line segment.

4. The e-paper display device according to claim 2, wherein the direction vector of the target display line segment is different from a direction vector of the current display line segment.

5. The e-paper display device according to claim 1, wherein an apex of the fan-shaped area is a terminal point of the current display line segment.

6. The e-paper display device according to claim 1, wherein a central angle and a radius of the fan-shaped area are predetermined.

7. The e-paper display device according to claim 1, wherein all line segments of the target display line segment are located in the display area.

8. The e-paper display device according to claim 1, wherein the pre-driven display area is a circular area, a center of the circular area is a terminal point of the current display line segment, and a radius of the circular area is predetermined.

9. A method for driving an e-paper display panel, configured to drive the e-paper display panel to display a current display line segment and a target display line segment, and comprising:

pre-driving a display area to display a first color during a frame period according to the current display line segment, wherein at least part of the target display line segment is located in the display area; and driving a part of the display area excluding the target display line segment to display a second color, and driving a part of the display area including the target display line segment to display the first color during a next frame period according to the target display line segment, wherein the pre-driven display area is a fan-shaped area, and the method further comprises:

determining a center vector of the fan-shaped area according to a direction vector of the current display line segment; and choosing one pattern to serve as the pre-driven display area from a plurality of fan-shaped patterns each having the center vector in a different direction according to the direction vector of the current display line segment, wherein the fan-shaped patterns are stored in a memory circuit.

10. The method for driving the e-paper display panel according to claim 9, wherein a starting point of the target display line segment is a terminal point of the current display line segment, and the method further comprises:

determining a direction vector of the target display line segment according to the terminal point of the current display line segment and a terminal point of the target display line segment.

11. The method for driving the e-paper display panel according to claim 10, wherein the direction vector of the target display line segment is same as a direction vector of the current display line segment.

12. The method for driving the e-paper display panel according to claim 10, wherein the direction vector of the target display line segment is different from a direction vector of the current display line segment.

13. The method for driving the e-paper display panel according to claim 9, wherein an apex of the fan-shaped area is a terminal point of the current display line segment.

14. The method for driving the e-paper display panel according to claim 9, wherein a central angle and a radius of the fan-shaped area are predetermined.

15. The method for driving the e-paper display panel according to claim 9, wherein all line segments of the target display line segment are located in the display area.

16. The method for driving the e-paper display panel according to claim 9, wherein the pre-driven display area is a circular area, a center of the circular area is a terminal point of the current display line segment, and a radius of the circular area is predetermined.

* * * * *